US010935045B2

(12) United States Patent
Wang

(10) Patent No.: US 10,935,045 B2
(45) Date of Patent: Mar. 2, 2021

(54) CENTRIFUGAL COMPRESSOR WITH INCLINED DIFFUSER

(71) Applicant: GM Global Technology Operations LLC, Detroit, MI (US)

(72) Inventor: Chijou Wang, Farmington Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 185 days.

(21) Appl. No.: 16/039,891

(22) Filed: Jul. 19, 2018

(65) Prior Publication Data

US 2020/0025214 A1 Jan. 23, 2020

(51) Int. Cl.

| | |
|---|---|
| ***F04D 29/44*** | (2006.01) |
| ***F04D 29/42*** | (2006.01) |
| ***F04D 17/10*** | (2006.01) |

(52) U.S. Cl.

CPC ..... *F04D 29/441* (2013.01); *F04D 17/10* (2013.01); *F04D 29/4233* (2013.01)

(58) Field of Classification Search

None

See application file for complete search history.

(56) References Cited

U.S. PATENT DOCUMENTS 4,900,225 A 2/1990 Wulf et al.
5,529,457 A 6/1996 Terasaki et al.
8,545,177 B2 * 10/2013 Dettmann ..... F04D 29/441 415/203
8,632,304 B2 * 1/2014 Sweetland ..... F01D 9/026 415/204
9,708,913 B2 * 7/2017 Martinez-Botas Mateo ..... F01D 5/12
10,066,639 B2 * 9/2018 Annati ..... F04D 17/06
10,280,936 B2 * 5/2019 Yoeda ..... F01D 9/026
2002/0106278 A1 * 8/2002 Koga ..... F04D 17/122 415/211.2

(Continued)

OTHER PUBLICATIONS

Noukhez Ahmed, Taimoor Asim, Rakesh Mishra, Subenuka Sivagnanasundaram, and Paul Eynon; "Optimal Vaneless Diffuser Design for a High-End Centrifugal Compressor"; Research paper from University of Huddersfield Repository dated Dec. 1-4, 2015, http://eprints.hud.ac.uk/id/eprint/26090/, pp. 1-9, United Kingdom.

*Primary Examiner* — Courtney D Heinle
*Assistant Examiner* — Jason Fountain
(74) *Attorney, Agent, or Firm* — Quinn IP Law

(57) ABSTRACT

A compressor includes a compressor impeller configured to rotate about an axis of rotation as intake gases flow along the compressor impeller. The compressor impeller includes an inducer and an exducer. The compressor impeller defines a first impeller end at the inducer and a second impeller end at the exducer. The second impeller end extends along a radial axis. The compressor further includes a compressor housing encasing the compressor impeller. The compressor housing defines a compressor volute. The compressor housing partially defines a diffuser in fluid communication with the compressor volute. The diffuser is elongated along a diffuser axis. The diffuser axis is obliquely angled relative to the axis of rotation. The diffuser axis is obliquely angled relative to the radial axis to minimize a turbulence of the intake gases flowing from the diffuser to the compressor volute.

14 Claims, 5 Drawing Sheets

(56) References Cited

U.S. PATENT DOCUMENTS

| | | | | |
|---|---|---|---|---|
| 2010/0178163 | A1* | 7/2010 | Dettmann | F04D 29/441<br>415/203 |
| 2010/0202877 | A1* | 8/2010 | Sweetland | F04D 29/441<br>415/204 |
| 2015/0132120 | A1* | 5/2015 | Yoeda | F01D 9/026<br>415/204 |
| 2016/0265550 | A1* | 9/2016 | Annati | F01D 9/048 |

* cited by examiner

CENTRIFUGAL COMPRESSOR WITH INCLINED DIFFUSER

INTRODUCTION

The present application relates to a centrifugal compressor with an inclined diffuser.

Internal combustion engines may use an exhaust driven compressor or turbocharger assembly to increase the manifold air pressure (MAP), thereby providing increased engine performance for a given engine displacement. A typical turbocharger assembly includes a turbine in fluid communication with the exhaust gases and a compressor in fluid communication with the intake gases. A portion of the energy contained within the exhaust gases operates to spin or rotate a turbine wheel disposed within the turbine assembly. The turbine wheel is connected to a compressor impeller of the compressor through a common shaft. As such, the turbine wheel and compressor impeller rotate in unison. In operation, as the exhaust gases rotate the turbine wheel, the rotating compressor impeller inducts or draws intake gases into the compressor where the intake gases are pressurized for subsequent introduction to the internal combustion.

SUMMARY

The present disclosure describes a centrifugal compressor with a diffuser that is inclined relative to the purely radial flow exit direction. This design reduces sensitivity of compressor performance (i.e., efficiency and flow stability) to manufacturing tolerances and geometric characteristics at the compressor exit, especially in the region where the compressor wheel exducer meets with the diffuser, and where the diffuser meets with the volute. Specifically, in the presently disclosed compressor, the flowpath of the intake gases from the compressor exducer into the diffuser is inclined relative to the radial axis of the compressor impeller. Also, the flow of intake gases from the diffuser enters into the volute at an inclined angle, thereby enhancing the performance of the compressor.

In some embodiments, the centrifugal compressor includes a compressor impeller configured to rotate about an axis of rotation as intake gases flow along the compressor impeller. The compressor impeller includes an inducer and an exducer. The compressor impeller defines a first impeller end at the inducer and a second impeller end at the exducer. The second impeller end extends along a radial axis, and the radial axis is perpendicular to the axis of rotation. The centrifugal compressor further includes a compressor housing encasing the compressor impeller. The compressor housing defines a compressor volute. The compressor housing partially defines a diffuser in fluid communication with the compressor volute. The diffuser is configured to convert a kinetic energy of the intake gases into static pressure. The diffuser is elongated along a diffuser axis. The diffuser axis is obliquely angled relative to the axis of rotation. The diffuser axis is obliquely angled relative to the radial axis to minimize a turbulence of the intake gases flowing from the diffuser to the compressor volute.

The centrifugal compressor may further include a center housing. The compressor housing includes a first diffuser wall. The center housing includes a second diffuser wall. The first diffuser wall and the second diffuser wall collectively define the diffuser, and each of the first diffuser wall and the second diffuser wall are obliquely angled relative to the radial axis. The first diffuser wall and the second diffuser wall are parallel to each other. Each of the first diffuser wall and the second diffuser wall are entirely linear. The diffuser defines a diffuser inlet and a diffuser outlet. The diffuser outlet is in direct fluid communication with the compressor volute. The exducer is closer to the diffuser inlet than to the diffuser outlet. The exducer is spaced apart from the inducer along a first direction. The first direction is parallel to the axis of rotation. The entirety of the first diffuser wall is parallel to the diffuser axis, and the entirety of the second diffuser wall is parallel to the diffuser axis.

A first distance is defined from the first impeller end to the diffuser outlet along the first direction. A second distance is defined from the first impeller end to the diffuser inlet along the first direction. The first distance is greater than the second distance to minimize the turbulence of the intake gases flowing from the diffuser to the compressor volute. The diffuser includes a diffuser pinch that is closer to the exducer than to the compressor volute, the diffuser pinch defines the diffuser inlet. The diffuser pinch is partially defined by a diffuser wall portion of the second diffuser wall. The entirety of the diffuser wall portion of the second diffuser wall is parallel to the diffuser axis to minimize the turbulence of the intake gases flowing from the compressor impeller to the diffuser. The diffuser pinch is partially defined by an inclined wall directly connected to the first diffuser wall. The inclined wall is obliquely angled relative to the first diffuser wall to facilitate a flow of the intake gases from the compressor impeller to the diffuser. The diffuser pinch has a tapered shape. As such, the pinch width of the diffuser pinch decreases in a second direction. The second direction is perpendicular to the first direction. The second direction is parallel to the radial axis. The diffuser inlet has a maximum inlet width. The diffuser outlet has a maximum outlet width. The maximum inlet width is greater than the maximum outlet width to the facilitate a flow of the intake gases from the compressor impeller to the diffuser.

The compressor housing defines a volute wall, and the volute wall defines the compressor volute, the volute wall includes a volute wall portion that is proximate to the second diffuser wall, the second diffuser wall includes a diffuser wall segment that is proximate to the volute wall portion, and the volute wall portion is spaced apart from the diffuser wall segment along the first direction to allow the intake gases to flow uninterrupted from the diffuser to the compressor volute.

The present disclosure also describes a turbocharger assembly including a compressor configured to pressurize intake gases as described above. The turbocharger assembly further includes a turbine coupled to the compressor. The turbine is configured to rotate about the axis of rotation. The turbine includes a turbine wheel and a turbine housing encasing the turbine wheel. The turbocharger assembly further includes a shaft interconnecting the compressor impeller and the turbine wheel.

The present disclosure also describes a vehicle system including an engine including an intake manifold and an exhaust manifold. The vehicle system also includes a turbocharger assembly as described above. The compressor of the turbocharger assembly is in fluid communication with the intake manifold, and the turbine of the turbocharger assembly is in fluid communication with the exhaust manifold.

The above features and advantages and other features and advantages of the present disclosure are readily apparent from the following detailed description of the best modes for carrying out the disclosure when taken in connection with the accompanying drawings.

DETAILED DESCRIPTION

Those having ordinary skill in the art will recognize that directional references (e.g., above, below, upward, up, downward, down, top, bottom, left, right, vertical, horizontal, etc.) are used descriptively for the FIGS. to aid the reader's understanding, and do not represent limitations (for example, to the position, orientation, or use, etc.) on the scope of the disclosure, as defined by the appended claims.

Referring to the FIGS., wherein like numerals indicate like or corresponding parts throughout the several views, a vehicle system 8 includes an internal combustion engine 10 configured to power a transmission (not shown). As non-limiting examples, the vehicle systems 8 may be a motor vehicle, marine vehicle, aerospace vehicle, robot, farm equipment or other movable platform.

Figure 1:
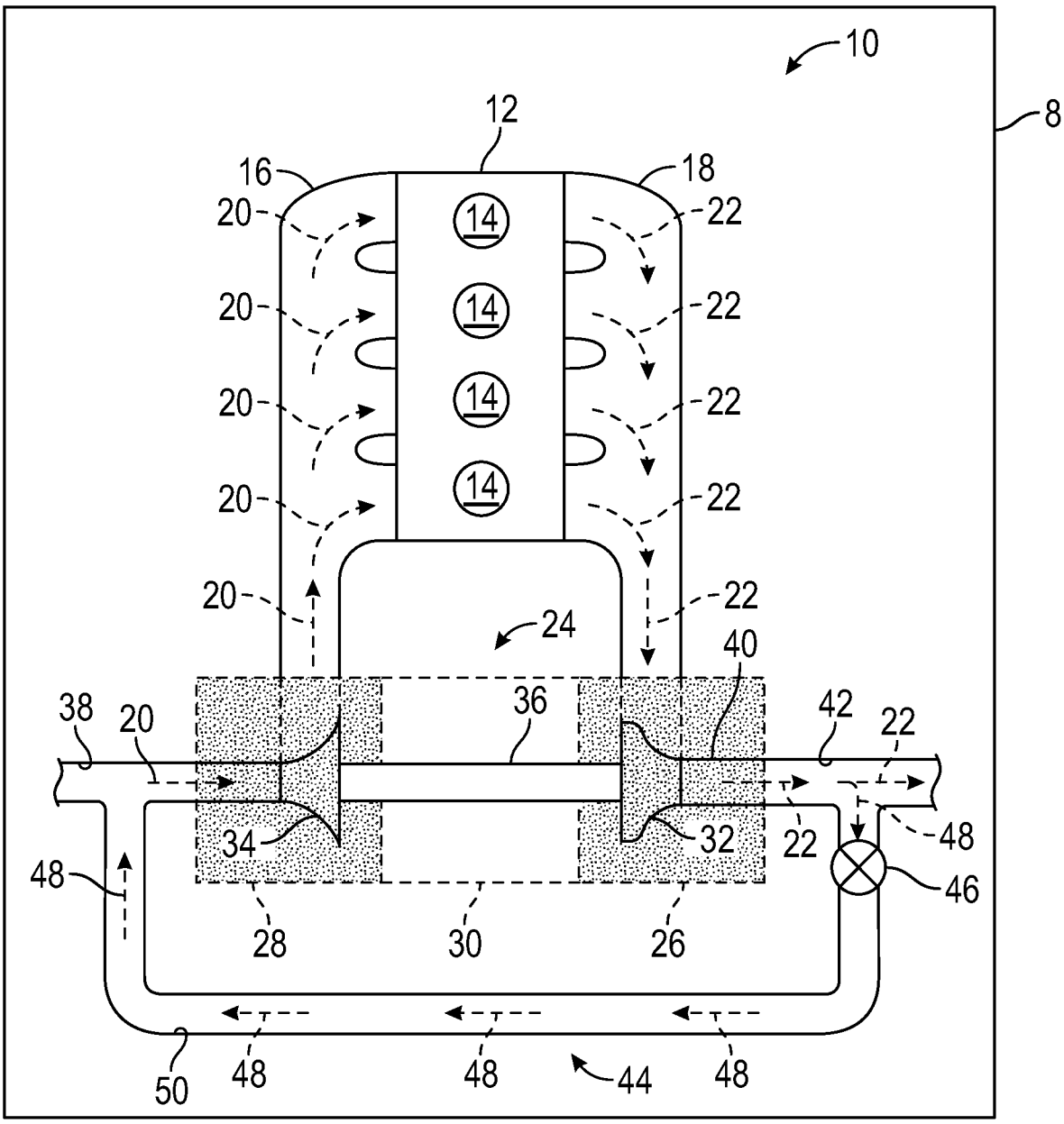
FIG. 1 is a schematic illustration of a vehicle including an internal combustion engine and a turbocharger assembly.

The internal combustion engine 10 may be a compression ignited or spark ignited type internal combustion engine. The internal combustion engine 10 includes an engine block 12 defining a plurality of cylinders 14. Although four cylinders 14 are shown in FIG. 1, the internal combustion engine 10 may include more or fewer cylinders 14. An intake manifold 16 and an exhaust manifold 18 are mounted to the internal combustion engine 10. The intake manifold 16 operates to communicate intake gases 20, such as air or recirculated exhaust gases, to the cylinders 14 of the internal combustion engine 10. The cylinders 14 at least partially define a variable volume combustion chamber operable to combust the intake gases 20 with a fuel (not shown). The products of combustion or exhaust gases 22 are expelled from the cylinders 14 into the exhaust manifold 18.

The internal combustion engine 10 further includes a turbocharger assembly 24. The turbocharger assembly 24 includes a turbine 26, a centrifugal compressor 28, and a center housing 30. The turbine 26 includes a turbine wheel 32 rotatable within the turbine 26. Similarly, the compressor 28 includes a compressor impeller 34 rotatable within the compressor 28. The center housing 30 supports a shaft 36 operable to interconnect the turbine wheel 32 and the compressor impeller 34. As such, the turbine wheel 32 and compressor impeller 34 rotate in unison. The compressor 28 is disposed in fluid communication with an inlet conduit 38 operable to introduce intake gases 20 to the turbocharger assembly 24. The compressor 28 is also disposed in fluid communication with the intake manifold 16 to introduce intake gases 20 thereto. Additionally, the turbine 26 is disposed in fluid communication with the exhaust manifold 18 to receive exhaust gases 22 therefrom. Exhaust gases 22 are communicated from an outlet 40 to an exhaust discharge conduit 42 for subsequent release to the atmosphere.

The internal combustion engine 10 may include an exhaust gas recirculation (EGR) system 44. The EGR system 44 includes a valve 46 operable to selectively and variably communicate a portion 48 of the exhaust gases 22 into a passage 50 for subsequent introduction to the inlet conduit 38. The portion 48 of the exhaust gases 22 may be introduced to the passage 50 either upstream or downstream of the turbine 26. The EGR system 44 can be used to reduce certain emission constituents, such as oxides of nitrogen.

In operation of the internal combustion engine 10, exhaust gases 22 are expelled from the cylinders 14 into the exhaust manifold 18. The exhaust gases 22 are transferred into the turbine housing 52 where a portion of the energy contained within the exhaust gases 22 is utilized to spin or rotate the turbine wheel 32. The exhaust gases 22 are then communicated to the exhaust discharge conduit 42. Because the shaft 36 interconnects the compressor impeller 34 and the turbine wheel 32, rotating the turbine wheel 32 causes the compressor impeller 34 to spin or rotate. The rotation of the compressor impeller 34 causes the intake gases 20 to be inducted into the compressor 28, where the intake gases 20 are pressurized and introduced to the intake manifold 16 for introduction to the cylinders 14. By increasing the pressure within the intake manifold 16, the density of the intake gases 20 is increased. As a consequence of this increase in density, a greater amount of fuel is oxidized and combusted within the cylinders 14, thereby increasing the peak pressure within the cylinders 14. As such, a greater amount of power may be produced from a turbocharged internal combustion engine compared to a naturally aspirated internal combustion engine of the same displacement.

Figure 2:
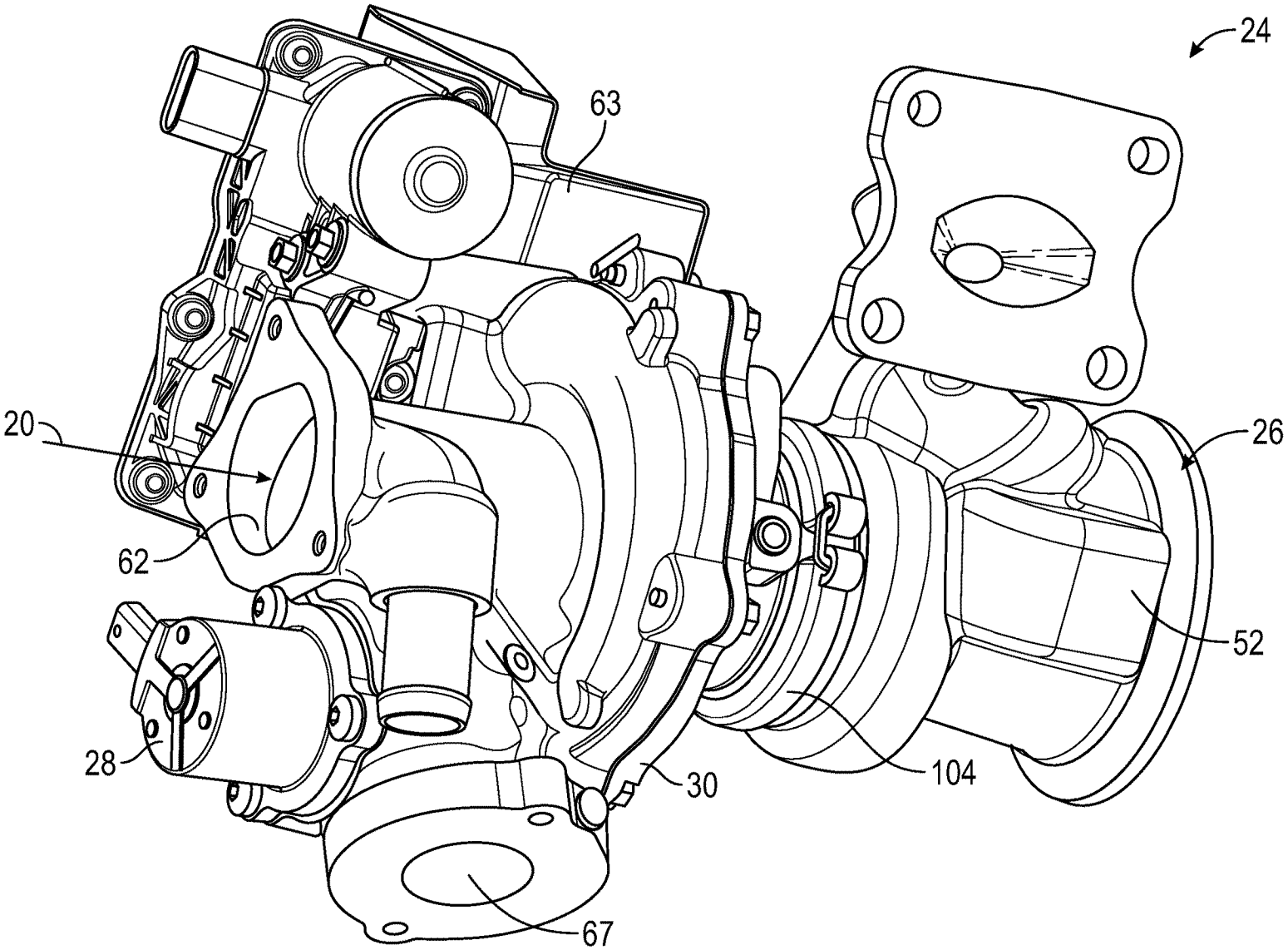
FIG. 2 is a schematic perspective view of the turbocharger assembly of FIG. 1.
Figure 3:
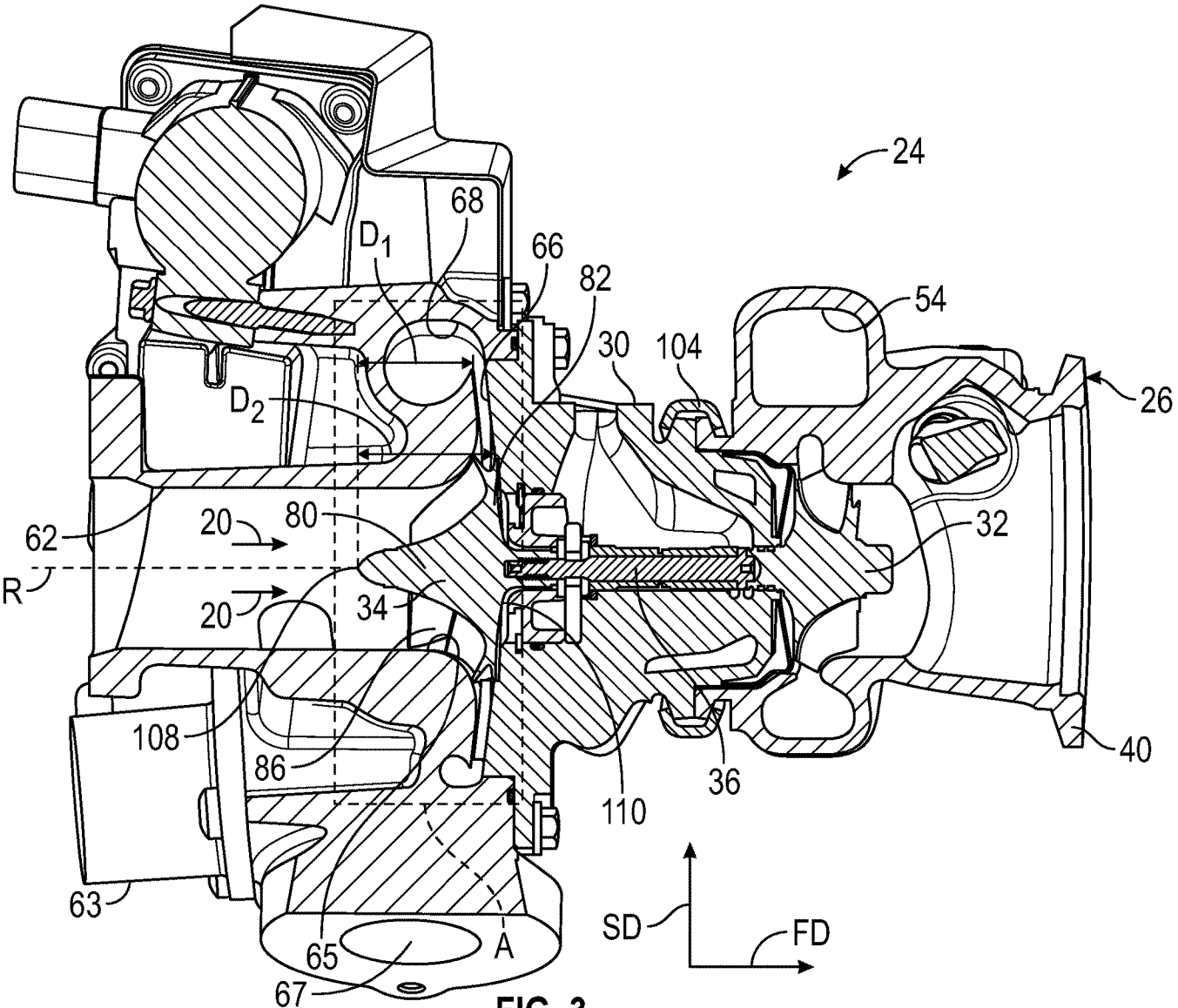
FIG. 3 is a schematic sectional side view of the turbocharger of FIG. 1.

Referring to FIGS. 2 and 3, an exemplary embodiment of the turbocharger assembly 24 includes the turbine 26, which in turn includes a turbine housing 52. The turbine housing 52 may be coupled to the center housing 30 with any suitable coupler 104 such as clamp. The turbine housing 52 defines a turbine scroll or turbine volute 54 operable to direct exhaust gases 22 radially inwardly toward the turbine wheel 32 to effect rotation thereof. The turbine 26 may further include a variable geometry mechanism (not shown) operable to vary the flow pattern of the exhaust gases 22 (FIG. 1) from the turbine volute 54 to the turbine wheel 32. The flow of exhaust gases 22 (FIG. 1) along the turbine wheel 32 causes the turbine wheel 32 to rotate or spin. Because the shaft 36 is coupled to the turbine wheel 32, the rotation of the turbine wheel 32 causes the shaft 36 to rotate as well. The rotation of the shaft 36 in turn drives the rotation of the compressor impeller 34 of the compressor 28.

Figure 4:
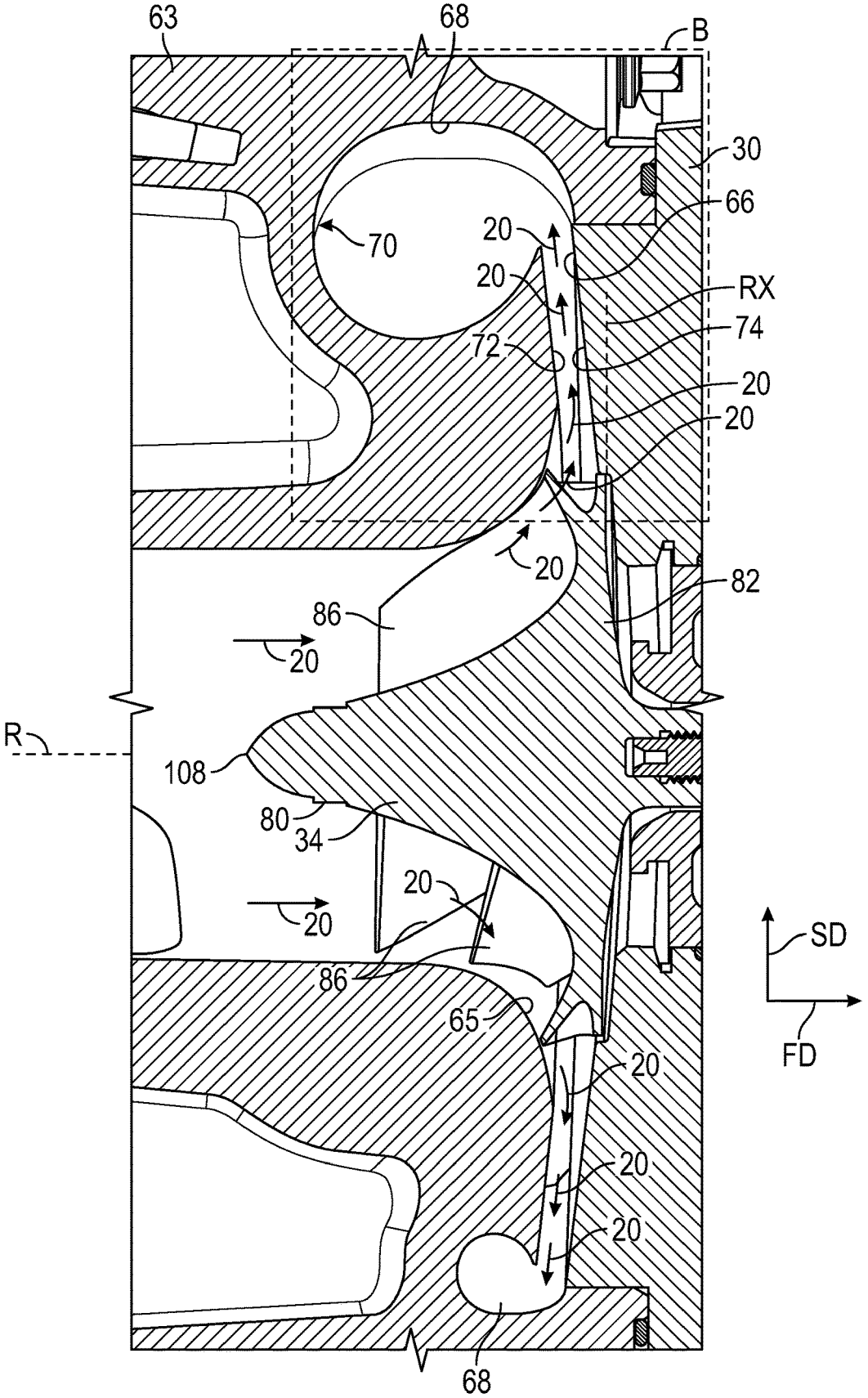
FIG. 4 is a schematic, enlarged, sectional side view of the turbocharger of FIG. 1, taken around area A of FIG. 3.

With reference to FIGS. 3 and 4, the compressor 28 includes a compressor housing 63, which defines an inlet 62 operable to direct intake gases 20 axially toward the compressor impeller 34. The center housing 30 is disposed between the turbine housing 52 and the compressor housing 63. The compressor housing 63 defines an inner compressor cavity 65 disposed in fluid communication with the inlet 62 and a compressor volute 68 operable to direct pressurized intake gases 20 radially outward toward the intake manifold 16 (FIG. 1). The compressor housing 63 encases the compressor impeller 34.

The compressor impeller 34 is disposed in the inner compressor cavity 65 and includes an inducer 80, an exducer 82, and a plurality of compressor vanes 86 disposed along the inducer 80 and the exducer 82. The exducer 82 is spaced apart from the inducer 80 along a first direction FD. The compressor impeller 34 includes a first impeller end 108 at the inducer 80 and a second impeller end 110 at the exducer 82. The first impeller end 108 is disposed farther from the turbine wheel 32 than the second impeller end 110. The second impeller end 110 extends along a radial axis RX (FIG. 4). The radial axis RX is perpendicular to the axis of rotation R. The first direction FD is parallel to the axis of rotation R. The radial axis is parallel to a second direction SD. The second direction SD is perpendicular to the first direction FD.

Upon rotation of the compressor impeller 34, the inducer 80 inducts intake gases 20 into the compressor housing 63. Once the intake gases 20 are inside the compressor housing 63, the compressor vanes 86 guide the flow of the intake gases 20 from the inducer 80 toward the exducer 82. While the compressor impeller 34 rotates, the exducer 82 directs the intake gases 20 from the compressor impeller 34 to the compressor volute 68 through a diffuser 66 defined by the compressor housing 63. The diffuser 66 converts the kinetic energy of the intake gases 20 into static pressure. The compressor volute 68 slows down the flow rate of the intake gases 20 and also converts kinetic energy of the intake gases 20 into pressure by reducing speed while increasing pressure. In the present disclosure, the term "volute" means a curved funnel that increases in area as it approaches a discharge port 67 of the compressor housing 63. Then, the compressor volute 68 directs the pressurized intake gases 20 toward the intake manifold 16 (FIG. 1) through the discharge port 67.

The compressor impeller 34 may have a substantially frusto-conical shape. As such, the compressor impeller 34 may have different cross-sectional dimensions or diameters along its length. In particular, the cross-sectional dimension of the compressor impeller 34 may increase in a first direction FD from the first impeller end 108 to the second impeller end 110. The first direction FD is parallel to the axis of rotation R.

Figure 5:
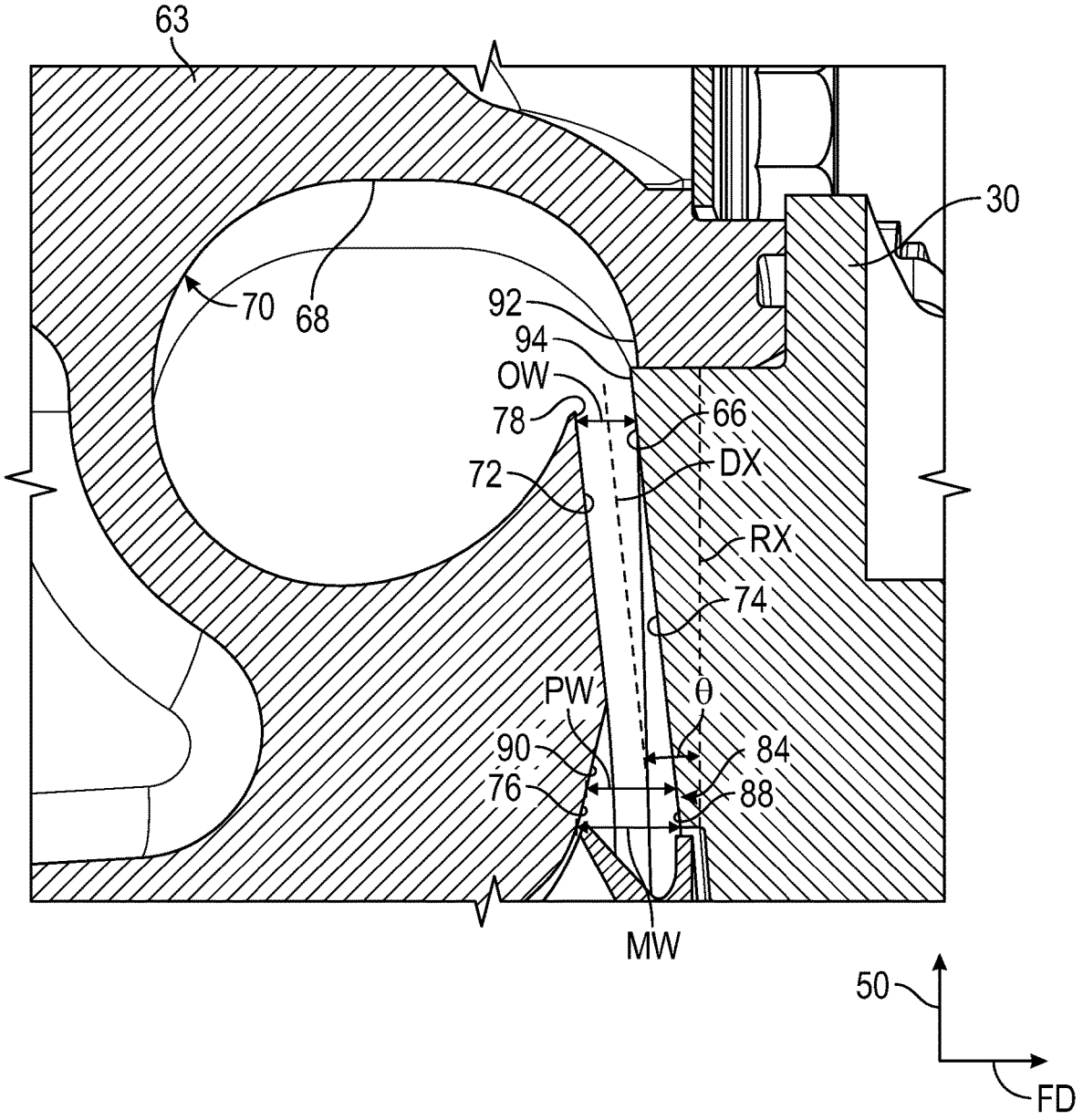
FIG. 5 is a schematic, enlarged, sectional side view of the turbocharger of FIG. 1, taken around area B of FIG. 4

With reference to FIGS. 4 and 5, the compressor housing 63 partially defines the diffuser 66. The diffuser 66 is in fluid communication with the compressor volute 68 and is configured to convert a kinetic energy of the intake gases 20 into static pressure. Further, the diffuser 66 is elongated along a diffuser axis, the diffuser axis is obliquely angled relative to the axis of rotation, the diffuser axis is obliquely angled relative to the radial axis RX to minimize a turbulence of the intake gases flowing from the diffuser to the compressor volute 68.

The compressor housing 63 defines a volute wall 70. The volute wall 70 defines the compressor volute 68. The compressor housing 63 includes a first diffuser wall 72. The center housing 30 includes a second diffuser wall 74. The first diffuser wall 72 and the second diffuser wall 74 collectively define the diffuser 66. Each of the first diffuser wall 72 and the second diffuser wall 74 are obliquely angled relative to the radial axis RX to minimize the turbulence of the intake gases 20 flowing through the diffuser 66. Thus, an oblique angle θ (FIG. 5) is defined from the diffuser axis DX to the radial axis RX. The oblique angle θ is greater than zero. By minimizing turbulence of the intake gases 20 flowing through the diffuser, pressure ratio of the compressor 28 is maximized, thereby enhancing the efficiency of the compressor 28. The first diffuser wall 72 and the second diffuser wall 74 are parallel to each other, and each of the first diffuser wall and the second diffuser wall are entirely linear to minimize the turbulence of the intake gases 20 flowing from the diffuser 66 to the compressor volute 68. Because the diffuser 66 is obliquely angled relative to the radial axis RX, the exducer flow angle is changed and causes the flow of the intake gases 20 to attach to second diffuser wall 74 longer, thus enhancing the compressor performance and reducing stack-up tolerance impact. Further, because the diffuser 66 is obliquely angled relative to the radial axis RX, the flow of intake gases 20 enters as mixed directional flow (i.e., not purely radial flow), thereby avoiding flow trip where diffuser 66 meets volute wall 70.

The diffuser 66 defines a diffuser inlet 76 and a diffuser outlet 78. The diffuser outlet 78 is in direct fluid communication with the compressor volute 68. The exducer 82 of the compressor impeller 34 is closer to the diffuser inlet 76 than to the diffuser outlet 78. The entire first diffuser wall 72 is parallel to the diffuser axis DX, and the entire the second diffuser wall 74 is parallel to the diffuser axis DX to minimize the turbulence of the intake gases 20 flowing through the diffuser 66. A first distance D1 (FIG. 3) is defined from the first impeller end 108 to the diffuser outlet 78 along the first direction FD. A second distance D2 (FIG. 3) is defined from the first impeller end 108 to the diffuser inlet 76 along the first direction FD. The first distance D1 is greater than the second distance D2 to minimize the turbulence of the intake gases 20 flowing from the diffuser 66 to the compressor volute 68.

The diffuser 66 includes a diffuser pinch 84 that is closer to the exducer 82 than the compressor volute 68. The diffuser pinch 84 defines the diffuser inlet 76 of the diffuser 66. Further, the diffuser pinch 84 is partially defined by a diffuser wall portion 88 of the second diffuser wall 74. The entire diffuser wall portion 88 of the second diffuser wall 74 is parallel to the diffuser axis DX to minimize the turbulence of the intake gases 20 flowing from the compressor impeller 34 to the diffuser 66. The bottom of the diffuser pinch 84 is undercut to prevent flow trip. As a result, the manufacturing tolerances at the diffuser pinch 84 may be greater than other compressors.

The diffuser pinch 84 is partially defined by an inclined wall 90 directly connected to the first diffuser wall 72. The inclined wall 90 is obliquely angled relative to the first diffuser wall 72 to facilitate the flow of the intake gases 20 from the compressor impeller 34 to the diffuser 66. The diffuser pinch 84 has a tapered shape. As such, the pinch width PW of the diffuser pinch 84 decreases in the second direction SD. As discussed above, the second direction SD is perpendicular to the first direction FD, and the second direction SD is parallel to the radial axis RX. The diffuser inlet 76 has a maximum inlet width MW, and the diffuser outlet 78 has a maximum outlet width OW. The maximum inlet width MW is greater than the maximum outlet width OW to facilitate the flow of the intake gases 20 from the compressor impeller 34 to the diffuser 66.

The volute wall 70 includes a volute wall portion 92 that is proximate to the second diffuser wall 74. The second diffuser wall 74 includes a diffuser wall segment 94 that is proximate to the volute wall portion 92. The volute wall portion 92 is spaced apart from the diffuser wall segment 94 along the first direction FD to allow the intake gases 20 to flow uninterrupted from the diffuser 66 to the compressor volute 68. In other words, the second diffuser wall 74 is not recessed relative to the volute wall 70 to avoid flow trip where diffuser 66 meets volute wall 70.

While the best modes for carrying out the disclosure have been described in detail, those familiar with the art to which this disclosure relates will recognize various alternative designs and embodiments for practicing the disclosure within the scope of the appended claims.

What is claimed is:

1. A centrifugal compressor, comprising:

a compressor impeller configured to rotate about an axis of rotation as intake gases flow along the compressor impeller, wherein the compressor impeller includes an inducer and an exducer, the compressor impeller defines a first impeller end at the inducer and a second impeller end at the exducer, the second impeller end extends along a radial axis, and the radial axis is perpendicular to the axis of rotation; and a compressor housing encasing the compressor impeller, wherein the compressor housing defines a compressor volute, the compressor housing partially defines a diffuser in fluid communication with the compressor volute, the diffuser is configured to convert a kinetic energy of the intake gases into static pressure, the diffuser is elongated along a diffuser axis, the diffuser axis is obliquely angled relative to the axis of rotation, the diffuser axis is obliquely angled relative to the radial axis to minimize a turbulence of the intake gases flowing from the diffuser to the compressor volute;

wherein the diffuser defines a diffuser inlet and a diffuser outlet, the diffuser outlet is in direct fluid communication with the compressor volute, the exducer is closer to the diffuser inlet than to the diffuser outlet, the exducer is spaced apart from the inducer along a first direction, the first direction is parallel to the axis of rotation, the diffuser outlet is spaced apart from the diffuser inlet along a second direction, the second direction is perpendicular to the first direction, a first distance is defined from the first impeller end to the diffuser outlet along the first direction, a second distance is defined from the first impeller end to the diffuser inlet along the first direction, and the second distance is greater than the first distance; further comprising a center housing, wherein the compressor housing includes a first diffuser wall, the center housing includes a second diffuser wall, the first diffuser wall and the second diffuser wall collectively define the diffuser, and each of the first diffuser wall and the second diffuser wall are obliquely angled relative to the radial axis; wherein the first diffuser wall and the second diffuser wall are parallel to each other.

2. The centrifugal compressor of claim 1, wherein each of the first diffuser wall and the second diffuser wall are entirely linear.

3. The centrifugal compressor of claim 2, wherein an entirety of the first diffuser wall is parallel to the diffuser axis, and an entirety of the second diffuser wall is parallel to the diffuser axis.

4. The centrifugal compressor of claim 3, wherein the diffuser includes a diffuser pinch that is closer to the exducer than to the compressor volute, the diffuser pinch defines the diffuser inlet, the diffuser pinch is partially defined by a diffuser wall portion of the second diffuser wall, and an entirety of the diffuser wall portion of the second diffuser wall is parallel to the diffuser axis to minimize the turbulence of the intake gases flowing from the compressor impeller to the diffuser.

5. The centrifugal compressor of claim 4, wherein the diffuser pinch is partially defined by an inclined wall directly connected to the first diffuser wall, and the inclined wall is obliquely angled relative to the first diffuser wall to facilitate a flow of the intake gases from the compressor impeller to the diffuser.

6. The centrifugal compressor of claim 5, wherein the diffuser pinch has a tapered shape such that a pinch width of the diffuser pinch decreases in the second direction, the second direction is perpendicular to the first direction, and the second direction is parallel to the radial axis, the diffuser inlet has a maximum inlet width, the diffuser outlet has a maximum outlet width, and the maximum inlet width is greater than the maximum outlet width to the facilitate the flow of the intake gases from the compressor impeller to the diffuser.

7. The centrifugal compressor of claim 6, wherein the compressor housing defines a volute wall, and the volute wall defines the compressor volute, the volute wall includes a volute wall portion that is proximate to the second diffuser wall, the second diffuser wall includes a diffuser wall segment that is proximate to the volute wall portion, and the volute wall portion is spaced apart from the diffuser wall segment along the first direction to allow the intake gases to flow uninterrupted from the diffuser to the compressor volute.

8. A turbocharger assembly, comprising:

a compressor configured to pressurize intake gases, wherein the compressor includes:

a compressor impeller configured to rotate about an axis of rotation as the intake gases flow along the compressor impeller, wherein the compressor impeller includes an inducer and an exducer, the compressor impeller defines a first impeller end at the inducer and a second impeller end at the exducer, the second impeller end extends along a radial axis, and the radial axis is perpendicular to the axis of rotation;

a compressor housing encasing the compressor impeller, wherein the compressor housing defines a compressor volute, the compressor housing partially defines a diffuser in fluid communication with the compressor volute, the diffuser is configured to convert a kinetic energy of the intake gases into static pressure, the diffuser is elongated along a diffuser axis, the diffuser axis is obliquely angled relative to the axis of rotation, the diffuser axis is obliquely angled relative to the radial axis to minimize a turbulence of the intake gases flowing from the diffuser to the compressor volute;

a turbine coupled to the compressor such that the turbine is configured to rotate about the axis of rotation, wherein the turbine includes a turbine wheel and a turbine housing encasing the turbine wheel; and a shaft interconnecting the compressor impeller and the turbine wheel; and wherein the diffuser defines a diffuser inlet and a diffuser outlet, the diffuser outlet is in direct fluid communication with the compressor volute, the exducer is closer to the diffuser inlet than to the diffuser outlet, the exducer is spaced apart from the inducer along a first direction, the first direction is parallel to the axis of rotation, the diffuser outlet is spaced apart from the diffuser inlet along a second direction, the second direction is perpendicular to the first direction, a first distance is defined from the first impeller end to the diffuser outlet along the first direction, a second distance is defined from the first impeller end to the diffuser inlet along the first direction, and the second distance is greater than the first distance; further comprising a center housing, wherein the compressor housing includes a first diffuser wall, the center housing includes a second diffuser wall, the first diffuser wall and the second diffuser wall collectively define the diffuser, and each of the first diffuser wall and the second diffuser wall are obliquely angled relative to the radial axis; wherein the first diffuser wall and the second diffuser wall are parallel to each other.

9. The turbocharger assembly of claim 8, wherein each of the first diffuser wall and the second diffuser wall are entirely linear.

10. The turbocharger assembly of claim 9, wherein the diffuser defines a diffuser inlet and a diffuser outlet, the diffuser outlet is in direct fluid communication with the compressor volute, the exducer is closer to the diffuser inlet than to the diffuser outlet, the exducer is spaced apart from the inducer along a first direction, the first direction is parallel to the axis of rotation, an entirety of the first diffuser wall is parallel to the diffuser axis, and an entirety of the second diffuser wall is parallel to the diffuser axis.

11. The turbocharger assembly of claim 10, wherein the diffuser includes a diffuser pinch that is closer to the exducer than to the compressor volute, the diffuser pinch defines the diffuser inlet, the diffuser pinch is partially defined by a diffuser wall portion of the second diffuser wall, and an entirety of the diffuser wall portion of the second diffuser wall is parallel to the diffuser axis to minimize the turbulence of the intake gases flowing from the compressor impeller to the diffuser.

12. The turbocharger assembly of claim 11, wherein the diffuser pinch is partially defined by an inclined wall directly connected to the first diffuser wall, and the inclined wall is obliquely angled relative to the first diffuser wall to facilitate a flow of the intake gases from the compressor impeller to the diffuser.

13. The turbocharger assembly of claim 12, wherein the diffuser pinch has a tapered shape such that a pinch width of the diffuser pinch decreases in the second direction, the second direction is perpendicular to the first direction, and the second direction is parallel to the radial axis, the diffuser inlet has a maximum inlet width, the diffuser outlet has a maximum outlet width, and the maximum inlet width is greater than the maximum outlet width to the facilitate the flow of the intake gases from the compressor impeller to the diffuser, the compressor housing defines a volute wall, and the volute wall defines the compressor volute, the volute wall includes a volute wall portion that is proximate to the second diffuser wall, the second diffuser wall includes a diffuser wall segment that is proximate to the volute wall portion, and the volute wall portion is spaced apart from the diffuser wall segment along the first direction to allow the intake gases to flow uninterrupted from the diffuser to the compressor volute.

14. A vehicle system, comprising:

an engine including an intake manifold and an exhaust manifold; and a turbocharger assembly including:

a compressor in fluid communication with the intake manifold, wherein the compressor includes:

a compressor impeller configured to rotate about an axis of rotation as intake gases flow along the compressor impeller, wherein the compressor impeller includes an inducer and an exducer, the compressor impeller defines a first impeller end at the inducer and a second impeller end at the exducer, the second impeller end extends along a radial axis, and the radial axis is perpendicular to the axis of rotation;

a compressor housing encasing the compressor impeller, wherein the compressor housing defines a compressor volute, the compressor housing partially defines a diffuser in fluid communication with the compressor volute, the diffuser is configured to convert a kinetic energy of the intake gases into static pressure, the diffuser is elongated along a diffuser axis, the diffuser axis is obliquely angled relative to the axis of rotation, the diffuser axis is obliquely angled relative to the radial axis to minimize a turbulence of the intake gases flowing from the diffuser to the compressor volute;

a turbine in fluid communication with the exhaust manifold, wherein the turbine includes a turbine wheel and a turbine housing encasing the turbine wheel; and a shaft interconnecting the compressor impeller and the turbine wheel, a center housing disposed between the turbine housing and the compressor housing; and wherein the compressor includes a first diffuser wall, the center housing includes a second diffuser wall, the first diffuser wall and the second diffuser wall collectively define the diffuser, and each of the first diffuser wall and the second diffuser wall are obliquely angled relative to the radial axis, the first diffuser wall and the second diffuser wall are parallel to each other, each of the first diffuser wall and the second diffuser wall are entirely linear, the diffuser defines a diffuser inlet and a diffuser outlet, the diffuser outlet is in direct fluid communication with the compressor volute, the exducer is closer to the diffuser inlet than to the diffuser outlet, the exducer is spaced apart from the inducer along a first direction, the first direction is parallel to the axis of rotation, an entirety of the first diffuser wall is parallel to the diffuser axis, an entirety of the second diffuser wall is parallel to the diffuser axis, a first distance is defined from the first impeller end to the diffuser outlet along the first direction, a second distance is defined from the first impeller end to the diffuser inlet along the first direction, and the second distance is greater than the first distance.

* * * * *